219-121

3/17/81 SR XR 4,256,779

United States Patent [19]

Sokol et al.

[11] 4,256,779

[45] Mar. 17, 1981

[54] PLASMA SPRAY METHOD AND APPARATUS

[75] Inventors: Larry S. Sokol, West Palm Beach; Charles C. McComas, Stuart; Earl M. Hanna, Greenacres, all of Fla.

[73] Assignee: United Technologies Corporation, Hartford, Conn.

[21] Appl. No.: 47,437

[22] Filed: Jun. 11, 1979

Related U.S. Application Data

[63] Continuation-in-part of Ser. No. 974,666, Nov. 3, 1978, which is a continuation of Ser. No. 834,087, Sep. 19, 1977, which is a continuation of Ser. No. 512,585, Oct. 7, 1974.

[51] Int. Cl.[3] ..... B05D 1/08

[52] U.S. Cl. ..... 427/34; 118/620; 219/121 P; 427/423

[58] Field of Search ..... 427/34, 423; 219/121 P; 239/81, 84, 85; 118/620

[56] References Cited

U.S. PATENT DOCUMENTS

| | | | |
|---|---|---|---|
| 2,960,594 | 11/1960 | Thorpe | 219/121 P |
| 3,010,009 | 11/1961 | Ducati | 427/34 |
| 3,075,065 | 1/1963 | Ducati et al. | 427/34 |
| 3,145,287 | 8/1964 | Siebein et al. | 239/81 |
| 3,301,995 | 1/1967 | Eschenbach et al. | 219/121 P |
| 3,676,638 | 7/1972 | Stand | 219/121 P |

OTHER PUBLICATIONS

Dorozhkin et al., "Soviet Powder Metallurgy and Metal Ceramics", vol. 13, No. 12(144), pp. 993-996, Dec. 1974.

*Primary Examiner*—John H. Newsome
*Attorney, Agent, or Firm*—Robert C. Walker

[57] ABSTRACT

A plasma spray method capable of directing plasticized powders against a substrate for deposition of a protective coating thereon is disclosed. Various structural details of the apparatus described enable the attainment of high particle velocities without melting the particles. The technical concepts employed are directed to normalizing the temperature of the plasma stream at a reduced value prior to the injection of coating particles. A general reduction in temperature and substantial elimination of a thermal spike at the core of the stream are achieved. Coating particles are injected into the plasma stream only after the plasma is first cooled and then preferably accelerated. In detailed embodiments, a nozzle extension assembly having a plasma cooling zone, a plasma acceleration zone, a powder injection zone and a plasma/powder discharge zone is affixed to the downstream end of a conventional plasma generator.

25 Claims, 3 Drawing Figures

PLASMA SPRAY METHOD AND APPARATUS

This is a continuation-in-part application of Ser. No. 974,666, filed Nov. 3, 1978 which is a continuation of application Ser. No. 834,087, filed Sept. 19, 1977 which is a continuation of application Ser. No. 512,585, filed Oct. 7, 1974.

BACKGROUND OF THE INVENTION

1. Field of the Invention

This invention relates to thermal spraying techniques, and more particularly to plasma spray methods and apparatus for directing plasticized powders at high velocities against a substrate to be coated.

2. Description of the Prior Art

Thermal spraying techniques are well developed in the art and have found good utility in the application of durable coatings to metallic substrates. A wide variety of metallic alloys and ceramic compositions have been applied to the developed prior art techniques. A number of such alloys and compositions are discussed in prior art reference and later in this specification.

All such thermal spray processes involve the generation of a high temperature carrier medium into which powders of the coating material are injected. The powders are heat-softened or melted in the carrier medium and are propelled against the surface of a substrate to be coated. Temperatures and velocities of the carrier mediums are extremely high, and residence times of the powders in the carrier medium are of short duration. Representative prior art coating apparatus is illustrated in U.S. Pat. Nos. 2,960,594 to Thorpe entitled "Plasma Flame Generator"; 3,145,287 to Siebein et al entitled "Plasma Flame Generator and Spray Gun"; 3,851,140 to Coucher entitled "Plasma Spray Gun and Method for Applying Coatings on a Substrate"; and 3,914,573 to Meuhlberger entitled "Coating Heat Softened Particles by Projection in a Plasma Stream of Mach 1 to Mach 3 Velocity".

All of the above cited patents disclose apparatus in which the carrier medium is an extremely high temperature stream of plasma particles. Such a plasma stream is typically generated within an electric arc. An inert gas, such as argon or helium, is flowed through the electric arc and is excited thereby, raising the gas particles in energy state to the plasma condition. Very large amounts of energy are imparted in this manner to the flowing medium. The large amounts of energy are required to enable acceleration of the gaseous medium to high velocities and to enable heating of the powders of coating material which are later injected into the plasma.

In a typical device, for example the Siebein et al device, a plasma generating arc is struck from a pintle shaped cathode to a cylindrical anode. The arc between the cathode and anode extends "way down" the cylindrical anode as is described in Siebein et al. The inert gas is forced through the arc and the plasma stream is formed. The stream is characterized by a thermal profile having a high temperature spike at the core of the stream. Anode lengths on the order of one and one-quarter ($1\frac{1}{4}$) inches are specified in the Siebein et al and Coucher patents, and are considered to be typical of modern plasma generators. Maximum plasma temperatures at the anode are on the order of twenty thousand degrees Fahrenheit (20,000° F.) or greater, necessitating cooling of the anode material to prevent rapid thermal deterioration of the structure. Cooling water is conventionally circulated around the anode for this purpose.

Powders of the coating material to be applied are injected into the plasma stream either at the end of the anode, as in Siebein et al and Muehlberger, or at the immediate downstream end theeof, as in Coucher. The powders preferably remain within the plasma stream for a sufficient period of time to become heat-softened or plasticized but not so long as to become liquified or vaporized.

Acceleration of the powders of coating material to high velocities approaching the substrate is known to be desirable. Increasing the relative differential velocity between the plasma and the powders and increasing the residence time of the powders within the streams are two techniques for approaching this goal. As a means for increasing the differential velocity, many scientists and engineers have proposed the injection of powders into supersonic plasma streams. The Muehlberger patent is representative of such concepts and suggests plasma velocities on the order of Mach 1 to Mach 3. Others have suggested confinement of the high temperature plasma/powder stream within a tubular member downstream of the anode. The Coucher patent is representative of such concepts.

Although many of the methods and devices disclosed in the above cited references do have utility in the coating industry, a search for yet improved coating methods and devices, particularly those capable of producing improved quality coatings at increased rates of material deposition, continues.

SUMMARY OF THE INVENTION

A primary aim of the present invention is to provide methods and apparatus for depositing coating materials on underlying substrates. High quality coatings and rapid rates of material deposition are sought. In one specific aspect of the invention, an object is to enable adequate acceleration of the coating powders in the plasma stream while passing the powders into a plasticized, but not molten, state. Powder delivery rates on the order of eight pounds per hour (8 lbs./hr.) or greater are desired.

According to the present invention the magnitude of the thermal spike in the temperature profile across the plasma stream emanating from the generator of a plasma spray device is substantially reduced and the average temperature of the plasma stream significantly lowered prior to the introduction of coating powders into the plasma stream.

According to one detailed apparatus a plasma spray device is formed of a conventional type plasma generator to which a plasma-treating, nozzle assembly having a plasma cooling zone, a plasma acceleration zone, a powder injection zone and a plasma/powder confinement zone is affixed.

A primary feature of the present invention is the plasma cooling zone within the nozzle assembly. Another feature is the plasma acceleration zone. Both the plasma cooling and plasma acceleration zones are located within the nozzle assembly upstream of the point at which particles of coating material are injectable into the plasma stream. In one embodiment two diametrically opposed particle injection ports are provided of admitting coating particles to the plasma stream. The plasma/particle mixture is dischargeable from the nozzle assembly through a mixture confining zone downstream of particle injection ports. An elongated passageway extends longitudinally through the zones of the nozzle assembly. A cooling medium, such as water, is circulatable about the nozzle structure which forms the passageway. In the acceleration zone the cross sectional area of the passageway in one embodiment is reduced to about one-fourth ($\frac{1}{4}$) of the cross sectional area of the passageway in the cooling zone. The cross sectional area of the passageway in the confining zone of the same embodiment is approximately six (6) times the cross sectional area of the passageway at the location of the power injection ports.

A principal advantage of the present invention is the ability of the described apparatus and method to apply high quality coatings at rapid deposition rates. Substantial elimination of the high temperature spike in the thermal profile at the core of the plasma stream in the injection zone, enables uniform heating of the injected particles and a resultantly homogeneous stream of plasticized particles. Reduction of the average temperature of the plasma to the order of twelve thousand degrees Fahrenheit (12,000° F.) at particle injection enables retention of the powder particles within the plasma stream while passing the powders into a plasticized, but not molten, state. Longer residence time of the particle in the plasma stream causes the powder particles to be accelerated to discharge velocities more closely approximating the plasma velocities than in prior art devices. Optimum coating structures, in a variety of coating systems can be produced with good material adherence and uniform density. Recovering velocity lost in the cooling step and further accelerating the plasma beyond its initial velocity increases the velocity differential between the plasma stream and the injected powders. These advantages are, moreover, achieved with concurrent improvements in process economy and safety.

The foregoing, and other objects, features and advantages of the present invention will become more apparent in the light of the following detailed description of the preferred embodiment thereof as shown in the accompanying drawing.

DETAILED DESCRIPTION

Figure 1:
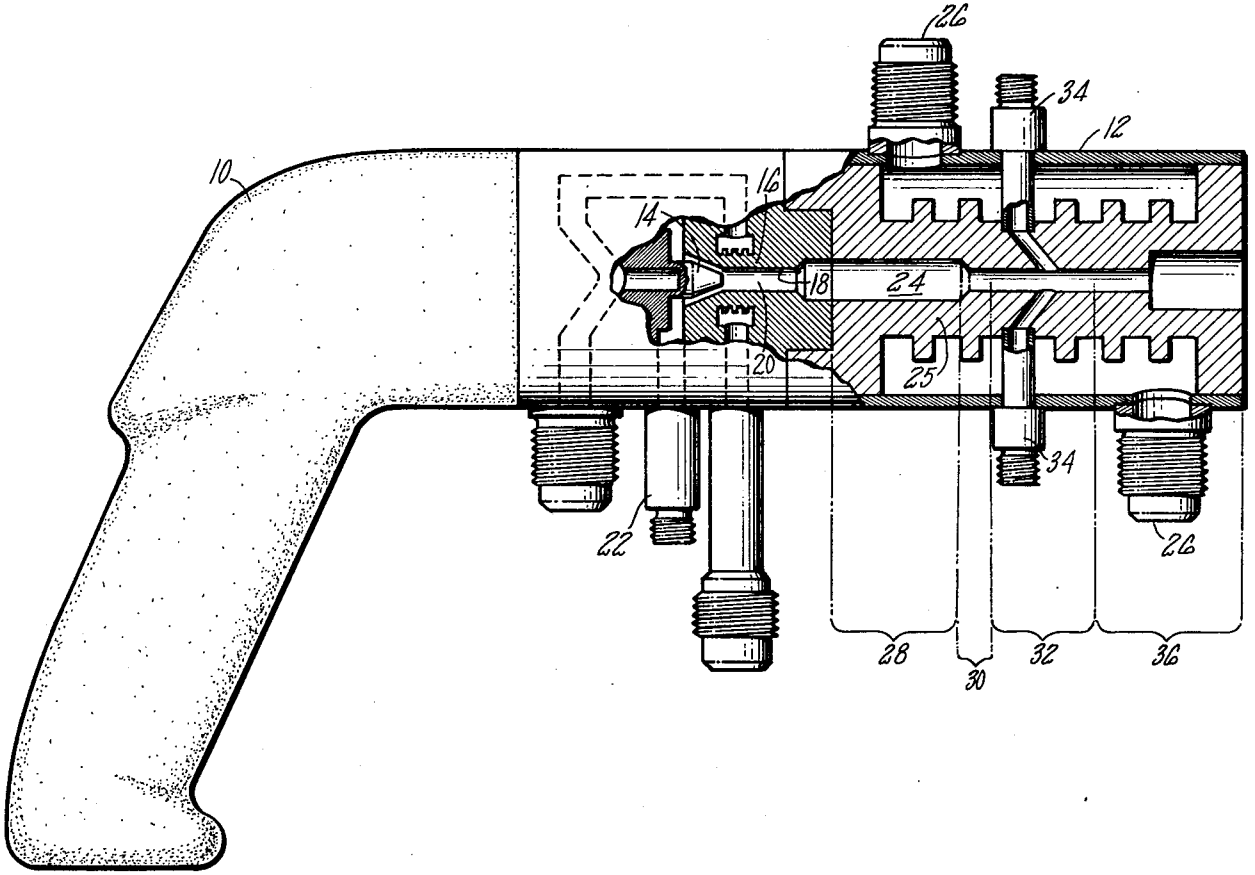
FIG. 1 is a simplified cross section view of apparatus implementing the concepts of the present invention.

Plasma spray apparatus of the present invention is described in detail in FIG. 1. The apparatus principally includes a conventional plasma generator 10 of the type referred to in the prior art section of this specification and a nozzle extension assembly 12. The generator is capable of producing a high velocity stream of high energy plasma and the nozzle extension assembly is operative on that stream in preparing the plasma for the injection of powder particles of coating material to be sprayed. The principal elements of the generator 10 include a pintle shaped cathode 14 and an anode 16. A cylindrical wall 18 of the anode defines a passageway 20 through the anode. The cylindrical wall is adapted to receive an electrical arc eminating from the cathode. The generator further includes means 22 for flowing a gaseous medium, such as helium or argon, through the electric arc between the cathode and the anode to generate the high velocity, high energy plasma. In the embodiment of the invention illustrated the generator must be capable of producing a plasma stream which is characterized by an average stream velocity on the order of two thousand feet per second (2000 fps) and an average plasma temperature within the stream on the order of fifteen thousand degrees Fahrenheit (15,000° F.). The Metco 3MB Plasma Gun with G Nozzle is known within the industry to be capable of producing such an effluent. Other plasma guns are likely to have utility in performing the concepts of the present invention. To the extent that such guns product effluents differing in characteristics from that of the Metco Gun, corresponding deviations in the detail design of the nozzle extension assembly are anticipated. Nevertheless, such a modified nozzle extension assembly will include the principal features hereafter described.

The nozzle extension assembly 12 abuts directly against the generator 10 and has an elongated passageway 24 which is in alignment with the passageway 20 through the anode of the generator. As illustrated, the passageway 24 extends through a tubular finned member 25. The passageway of the presently illustrated device is both shorter and wider than the corresponding passageway of the device illustrated in the copending parent to this continuation-in-part application. Effluent from the generator is dischargeable directly into the passageway 24 of the extension assembly. Conduit means 26 is adapted to flow cooling medium such as water through the extension assembly. A plasma cooling zone 28 is located at the upstream end of the passageway 24 and is provided for reducing the temperature of the plasma prior to the injection of the particles of coating material. The passageway 24 at the cooling zone extends for an axial length of approximately one inch (1 in.) and has a diameter of two hundred eighty seven thousandths of an inch (0.287 in.). The diameter of the passageway at the cooling zone and the diameter of the anode passageway to which the extension assembly aligns are made to correspond. In the embodiment illustrated the cross sectional area of the passageway 24 at the cooling zone is greater than the cross sectional area defined by the cylindrical wall 18 of the anode to which the electric arc is struck. The remaining geometric dimensions and parameters are sized from this basic dimension.

A plasma acceleration zone 30 along the passageway 24 immediately downstream of the cooling zone is provided for accelerating the cooled plasma stream. In this embodiment the acceleration zone is not only adapted to recover velocity lost in the cooling zone, but is adapted to accelerate the cooled plasma to velocities well in excess of the plasma velocity entering the nozzle extension. Within the acceleration zone of the illustrated nozzle the diameter of the passageway is reduced to approximately one hundred fifty two thousandths of an inch (0.152 in.) from an initial diameter of two hundred eighty seven thousandths of an inch (0.287 in.). This represents a cross sectional area reduction of approximately one-fourth ($\frac{1}{4}$), although somewhat greater or lesser area reductions are likely workable.

A powder particle introduction zone 32 along the passageway 24 immediately downstream of the acceleration zone 30 is provided for admitting or injecting powder particles of coating material into the cooled and accelerated plasma stream. Particles are flowable into the passageway through one or more powder ports 34. Two diametrically opposed powder ports are illustrated. With two ports as illustrated powder delivery rates on the order of eight pounds per hour (8 lbs./hr.) are attainable. The passageway in the introduction zone is approximately one hundred fifty two thousandths of an inch (0.152 in.) in diameter. Plasma velocities entering the introduction zone are on the order of eleven to fourteen thousand feet per second (11,000–14,000 fps).

A plasma/particle confining zone 36 is provided along the passageway 24 downstream of the particle introduction zone for enabling the particles to be accelerated by the plasma stream before the particles are discharged from the apparatus. The confining zone extends to a distance of approximately one inch (1 in.) downstream from the point of powder introduction. The passageway 24 in the confining zone opens to a diameter of approximately three hundred seventy thousandths of an inch (0.370 in.) at the end of the nozzle assembly. This represents a cross sectional area increase from the injection zone at approximately six (6) times the injection zone area. Particle velocities on the order of two thousand feet per second (2000 fps) are attainable in the described apparatus.

Figure 2:
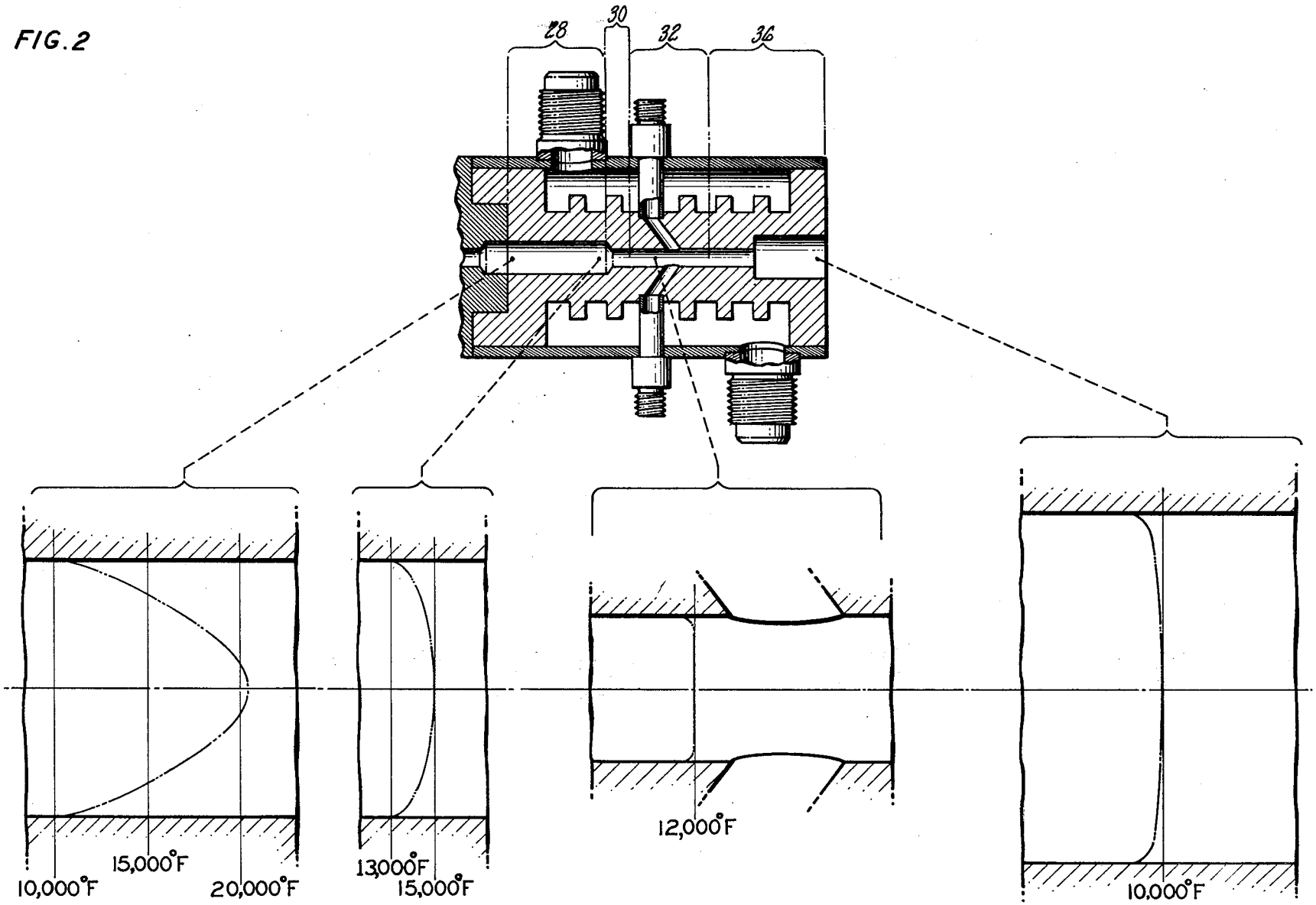
FIG. 2 is a diagrammatic represntation of the temperature profile of the plasma at various stations along the passageway through the nozzle assembly.

As has been previously discussed, the effluent upon which the nozzle extension assembly is operative is in a high energy state. The electric arc between the cathode and the anode breaks down the structure of the gas molecules to produce a plasma stream containing an assemblage of ions, electrons, neutral atoms and molecules. The stream is characterized by an average temperature and a thermal spike at the core of the stream which greatly exceeds that average temperature, perhaps one-third ($\frac{1}{3}$) greater. The temperature profile across the stream is illustrated in FIG. 2 and the thermal spike is readily viewable in the representation at the upstream end of the plasma cooling zone 28. As the plasma passes through the cooling zone, the average temperature is reduced on the order of two thousand degrees Fahrenheit (2000° F.) or ten to fifteen percent (10–15%) from fifteen thousand degrees Fahrenheit (15,000° F.) to thirteen thousand degrees Fahrenheit (13,000° F.). Of equal importance the temperature of the plasma in the core ie even more greatly reduced from twenty thousand degrees Fahrenheit (20,000° F.) or greater to around fifteen thousand degrees Fahrenheit (15,000° F.), or within approximately two thousand degrees Fahrenheit (2000° F.) or approximately fifteen percent (15%) of the average plasma temperature in that region. As the plasma passes through the acceleration zone the plasma has reached a nearly uniform temperature on the order of twelve thousand degrees Fahrenheit (12,000° F.). Substantial elimination of the thermal spike to provide a nearly uniform plasma temperature profile at the point of powder injection is important. The above described normalization of the plasma temperature is illustrated by FIG. 2.

Figure 3:
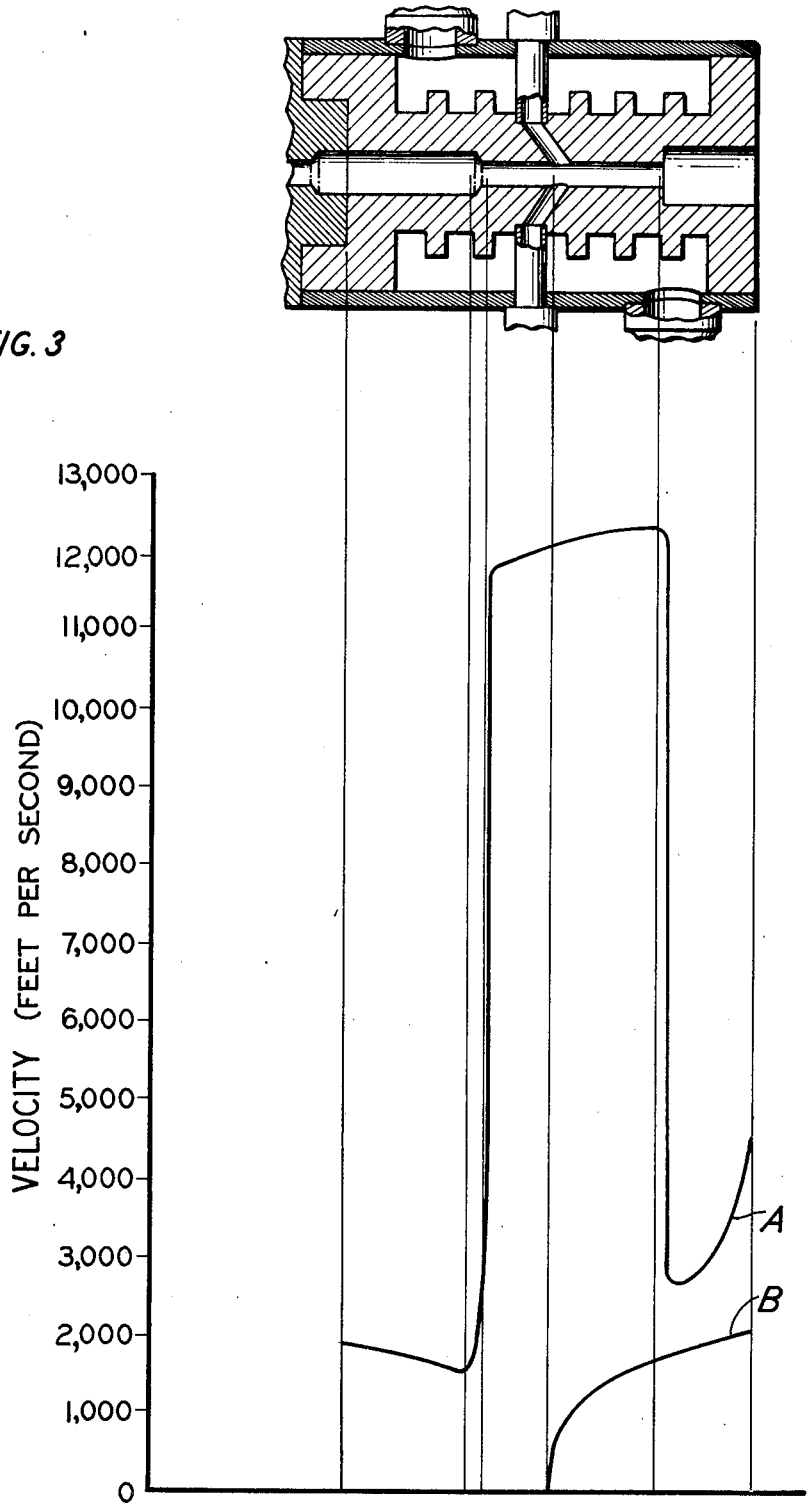
FIG. 3 is a graph illustrating the velocity of the plasma and the powder particles along the passageway through the nozzle assembly.

Powders are injected into the stream through the ports 34 and are heated by the plasma. The particles are accelerated by the plasma. Approximate corresponding plasma or gas velocities (curve A) and particle velocities (curve B) are illustrated in FIG. 3. As the particles progress downstream through the nozzle assembly the powder particles are heated to a plasticized state. The nearly uniform plasma temperature profile causes all particles to be heated to the same degree of softness, and a homogeneous stream of particles emanating from the nozzle results. Rates of cooling flow to the nozzle extension assembly are controlled to yield plasticized powders in the stream at the point of incidence on the substrate to be coated. The average temperature of the plasma discharging from the nozzle extension assembly is on the order of ten thousand degrees Fahrenheit (10,000° F.) or two-thirds ($\frac{2}{3}$) of the originally provided average temperature.

The particular apparatus described has been specifically developed for the deposition of nickel alloy or cobalt alloy powders such as those typified by the NiCrAlY composition described as follows:

14–20 wt. % chromium;
11–13 wt. % aluminum;
0.10–0.70 wt. % yttrium;
2 wt. % maximum cobalt; and
balance nickel.

Particles sized to the order of five to forty-five (5–45) microns have been successfully applied. Additionally, the nozzle extension apparatus is well suited to the deposition of Haynes Stellite Alloy No. 6, a hard facing alloy which is procurable from Stellite Division of Cabot Corporation, Kokomo, Indiana. The Stellite Alloy No. 6 is utilized in the automotive industry as, for example, a coating material improving the wear resistance of valves of internal combustion engines.

The concepts of the present invention enable high energy levels to be initially imparted to the plasma stream in acceleration of the stream within the carrying passageways. Although reductions in plasma temperature along the passageway can be achieved by reducing the power input to the generator, the resultant energy in the plasma stream is correspondingly reduced and the acceleration effects of the plasma on the powder are not as great. The ability of the plasma to accelerate rapidly within the generator is not inhibited substantially by the reduction in plasma temperature in the nozzle assembly.

Those skilled in the art will recognize that empirical temperature and velocity measurements within a plasma stream are without the state of the art to accurately measure. Applicants have, therefore, analytically quantified conditions and states within the plasma stream to aid in understanding the inventive concepts taught. Actual temperature and velocity conditions may vary from those recited in the specification without departure from the fundamental concepts taught and claimed.

Having thus described a typical embodiment of our invention, that which we claim as new and desire to secure by Letters Patent of the United States is:

1. In a method for applying a high temperature capability material onto a substrate of the type in which the material to be applied is carried to the substrate in a high energy plasma stream, the improvement which comprises:

providing a stream of high temperature plasma which is characterized by an average temperature in degrees Fahrenheit across the stream and a temperature spike at the center of the stream which has a magnitude approximately one-third ($\frac{1}{3}$) greater in degrees Fahrenheit than the average temperature;

passing the high temperature plasma through an extended cooling zone of sufficient length and of sufficient cooling capacity to achieve an average plasma temperature reduction of approximately ten to fifteen percent (10–15%) as expressed in degrees Fahrenheit and a reduction in the magnitude of the temperature spike to within approximately fifteen percent (15%) as expressed in degrees Fahrenheit of the reduced average temperature;

introducing powders of said high temperature capability material into the reduced temperature plasma stream;

confining the plasma stream and introduced powders within an elongated passageway;

accelerating and heating said introduced powders within the elongated passageway;

further reducing the average temperature of the provided stream within the elongated passageway to approximately two-thirds ($\frac{2}{3}$) of the original provided average temperature as expressed in degrees Fahrenheit; and discharging said accelerated and heated powders from said elongated passageway and directing said powders against the substrate to be coated.

2. The method according to claim 1 wherein said step of providing a stream of high temperature plasma includes the step of providing a stream which is characterized by an average temperature across the stream of approximately fifteen thousand degrees Fahrenheit (15,000° F.) and a temperature spike at the center of the stream in excess of twenty thousand degrees Fahrenheit (20,000° F.); and wherein said step of reducing the average temperature of the provided stream includes the steps of reducing the average temperature of the provided stream to approximately thirteen thousand degrees Fahrenheit (13,000° F.), and reducing the magnitude of the temperature spike at the center of the stream to within approximately two thousand degrees Fahrenheit (2000° F.) of the reduced average temperature.

3. The method according to claim 1 or 2 which includes the step of accelerating said reduced temperature plasma prior to the step of introducing powders of said high temperature capability material.

4. The method according to claim 3 wherein the step of accelerating said reduced temperature plasma includes the step of accelerating said reduced temperature plasma to a velocity of approximately eleven to fourteen thousand feet per second (11,000–14,000 fps).

5. In a plasma generator and spray device of the type for depositing particles of coating material on a substrate and of the type in which the particles of coating material are heated and accelerated by a plasma stream generated within the device, the improvement which comprises:

a plasma generator capable of producing a columnar stream of plasma effluent at an average plasma velocity within the stream which is approximately two thousand feet per second (2000 fps) and at an average plasma temperature which is approximately fifteen thousand degrees Fahrenheit (15,000° F.); and a coolable nozzle having an elongated passageway therethrough which is adapted to receive said plasma effluent having an average velocity of approximately two thousand feet per second (2000 fps) and an average temperature of approximately fifteen thousand degrees Fahrenheit (15,000° F.) wherein said nozzle has means having sufficient length and sufficient cooling capacity at the upstream end of the passageway for reducing the average temperature of the plasma stream, means along the passageway immediately downstream of said temperature reducing means for accelerating the reduced temperature plasma to an average velocity in excess of the average velocity of the plasma at the upstream end of said temperature reducing means, means along the passageway immediately downstream of said accelerating means for admitting particles of coating material into said cooled and accelerated plasma, and means along the passageway immediately downstream of said particle admitting means for confining said particles within the cooled and accelerated plasma stream for a sufficient time interval to enable the particles to be heated to a plasticized state.

6. The invention according to claim 5 wherein the cross sectional area of said passageway is reduced across the means for accelerating the cooled plasma to approximately one-fourth ($\frac{1}{4}$) of the cross sectional area of said passageway at the temperature reducing means.

7. The invention according to claim 6 wherein the cross sectional area of the passageway at said confining means is approximately six (6) times greater than the cross sectional area of the passageway at said particle admitting means.

8. The apparatus according to claim 7 wherein said generator includes a pintle shaped cathode and an anode having a cylindrical wall to which an electric arc is struck in the plasma generation process and through which the generated plasma stream is flowable, and wherein the passageway at said means for reducing the temperature of the generated plasma has a cross sectional area which is larger than the cross sectional area bounded by said cylindrical wall of the anode.

9. The apparatus according to claim 7 wherein said passageway at the temperature reducing means has an approximate two hundred eighty seven thousandths of an inch (0.287 in.) diameter, circular cross section geometry, and has an approximate one inch (1 in.) axial length.

10. The apparatus according to claim 9 wherein said passageway at the accelerating means has an approximate two hundred eighty seven thousandths of an inch (0.287 in.) diameter, circular cross section geometry, at the upstream end thereof and has an approximate one hundred fifty two thousandths of an inch (0.152 in.) diameter, circular cross section geometry at the downstream end thereof.

11. The apparatus according to claim 10 wherein said passageway at the particle admitting means has an approximate one hundred fifty two thousandths of an inch (0.152 in.) diameter, circular cross section geometry and at least one aperture along said passageway through which particles of said coating material are flowable into said cooled and accelerated plasma.

12. The apparatus according to claim 11 which includes two of said apertures located in diametrically opposed relationships along said passageway.

13. The apparatus according to claim 11 or 12 wherein said passageway at the confining means has a circular cross section geometry of a diameter in excess of the diameter of the passageway at the admitting means.

14. The apparatus according to claim 13 wherein said passageway at the confining means has a diameter of approximately three hundred seventy thousandths of an inch (0.370 in.).

15. The apparatus according to claim 13 wherein said passageway at the confining means extends to a distance of approximately one inch (1 in.) downstream of the apertures through which said coating particles are admitted.

16. The apparatus according to claim 14 wherein said passageway of the confining means extends to a distance of approximately one inch (1 in.) downstream of the apertures through which said coating particles are admitted.

17. The apparatus according to claim 8 wherein said passageway at the temperature reducing means has an approximate two hundred eighty seven thousandths of an inch (0.287 in.) diameter, circular cross section geometry, and has an approximate one inch (1 in.) axial length.

18. The apparatus according to claim 17 wherein said passageway at the accelerating means has an approximate two hundred eighty seven thousandths of an inch (0.287 in.) diameter, circular cross section geometry, at the upstream end thereof and has an approximate one hundred fifty two thousandths of an inch (0.152 in.) diameter, circular cross section geometry at the downstream end thereof.

19. The apparatus according to claim 18 wherein said passageway at the particle admitting means has an approximate one hundred fifty two thousandths of an inch (0.152 in.) diameter, circular cross section geometry and at least one aperture along said passageway through which particles of said coating material are flowable into said cooled and accelerated plasma.

20. The apparatus according to claim 19 which includes two of said apertures located in diametrically opposed relationships along said passageway.

21. The apparatus according to claim 19 or 20 wherein said passageway at the confining means has a circular cross section geometry of a diameter in excess of the diameter of the passageway at the admitting means.

22. The apparatus according to claim 21 wherein said passageway at the confining means has a diameter of approximately three hundred seventy thousandths of an inch (0.370 in.).

23. The apparatus according to claim 21 wherein said passageway at the confining means extends to a distance of approximately one inch (1 in.) downstream of the apertures through which said coating particles are admitted.

24. The apparatus according to claim 22 wherein said passageway of the confining means extends to a distance of approximately one inch (1 in.) downstream of the apertures through which said coating particles are admitted.

25. The apparatus according to claim 7, 8, 9 or 10 wherein said means for accelerating the reduced temperature plasma is capable of accelerating said reduced temperature plasma to a velocity of approximately eleven to fourteen thousand feet per second (11,000 to 14,000 fps).

* * * * *

UNITED STATES PATENT AND TRADEMARK OFFICE

CERTIFICATE OF CORRECTION

PATENT NO. : 4,256,779

DATED : March 17, 1981

INVENTOR(S) : Larry S. Sokol et al

It is certified that error appears in the above—identified patent and that said Letters Patent is hereby corrected as shown below:

| | |
|---|---|
| Col. 1, line 21 | "to" should read -- by -- |
| Col. 1, line 23 | "reference" should read -- references -- |
| Col. 2, line 15 | "streams" should read -- stream -- |
| Col. 3, line 11 | "power" should read -- powder -- |
| Col. 4, line 14 | "product" should read -- produce -- |

Signed and Sealed this

Fourteenth Day of July 1981

[SEAL]

Attest:

GERALD J. MOSSINGHOFF

Attesting Officer

Commissioner of Patents and Trademarks